United States Patent [19]

Yamazaki

[11] 4,188,138

[45] Feb. 12, 1980

[54] SWITCH MEANS FOR JOURNAL PAPER FEEDING AND RECEIPT PAPER FEEDING CONTROL CIRCUIT

[75] Inventor: Masao Yamazaki, Kawaguchi, Japan

[73] Assignee: Copal Company Limited, Tokyo, Japan

[21] Appl. No.: 927,376

[22] Filed: Jul. 24, 1978

[30] Foreign Application Priority Data

Aug. 10, 1977 [JP] Japan ..... 52-106245[U]

[51] Int. Cl.[2] ..... B41F 13/00; G06C 25/00

[52] U.S. Cl. ..... 400/586; 400/589; 400/564; 235/130 R; 200/335

[58] Field of Search ..... 400/578, 586, 589, 563, 400/564; 235/130 R, 433; 200/6 R, 6 B, 6 BA, 6 BB, 50 C, 250, 290, 329, 335, 336

[56] References Cited

U.S. PATENT DOCUMENTS

| | | | |
|---|---|---|---|
| 2,279,858 | 4/1942 | Breitling et al. | 400/589 X |
| 2,372,892 | 4/1945 | Ghertman | 400/586 X |
| 2,441,870 | 5/1948 | Christian | 400/589 X |
| 2,998,905 | 9/1961 | Bieber | 400/586 X |
| 3,030,010 | 4/1962 | Sunstrand | 235/130 R |
| 3,393,867 | 7/1968 | Dale et al. | 235/130 R |
| 3,902,418 | 9/1975 | Morishita et al. | 400/586 X |

*Primary Examiner*—E. H. Eickholt
*Attorney, Agent, or Firm*—J. Harold Nissen

[57] ABSTRACT

The printer includes at least a receipt paper feeding and printing mechanism and a journal paper feeding and printing mechanism each operated in synchronism by a control circuit. A mechanical switching means is provided in either one of the receipt and journal paper feeding and printing mechanism adapted to be operated for rendering it to be inoperative and a switch is provided connecting the one of the receipt and journal paper feeding and printing mechanism to the control circuit. The switch is operatively coupled with the switching means so that, when the one of the receipt and journal paper feeding and printing mechanisms is rendered to be inoperative by the switching means, the switch is opened so as to electrically disconnect the one of the receipt and journal paper feeding and printing mechanism from the control circuit.

3 Claims, 5 Drawing Figures

SWITCH MEANS FOR JOURNAL PAPER FEEDING AND RECEIPT PAPER FEEDING CONTROL CIRCUIT

BACKGROUND OF THE INVENTION

The present invention relates to a printer and, more particularly, to a printer having a receipt paper printing mechanism and a journal paper printing mechanism operated in synchronism with each other such as used in an electronic cash register wherein either one of the printing mechanisms can be optionally rendered to be inoperative.

Heretofore, simultaneous printing operation can be easily achieved in both the receipt paper printing mechanism and the journal paper printing mechanism of a printer used in an electronic cash register. However, it is often required in a printer of an electronic cash register to operate only the journal paper printing mechanism while the receipt paper printing mechanism is kept inoperative.

In case a compact electronic table printer is modified so as to be incorporated in an electronic cash register, the paper feeding mchanism and the printing mechanism are integrally constructed as a unit in such a printer so that an additional receipt paper arresting mechanism must be incorporated in the unit in order to satisfy the above requirement. In such a case, however, the printing mechanism for the receipt paper is still operated in synchronism with the printing mechanism for the journal paper so that repeated printing operation is effected on the receipt paper stationarily held by the receipt paper arresting mechanism thereby giving damages to the receipt paper, the ink ribbon and the members relating to the printing operation. In order to avoid the above disadvantages, it is necessary to provide a switch between the control circuit of the printer and the receipt paper printing mechanism for disconnecting the latter from the former when it is desired to render the receipt paper printing operation to be inoperative. Such a switch may be provided separately from the receipt paper arresting mechanism. In this case, however, the manipulation of the cash register is made complicated rendering false function to occur.

The present invention aims at avoiding the above disadvantages.

SUMMARY OF THE INVENTION

The object of the present invention is to provide a novel and useful printer such as that adapted for use in an electronic cash register which avoids the above described disadvantages and which is simple in construction and accurate in function without causing any false functions.

The above object is achieved in accordance with the present invention by the provision of a printer having at least a receipt paper feeding and printing mechanism and a journal paper feeding and printing mechanism each adapted to be operated in synchronism by a control circuit, wherein the improvement comprises mechanical switching means adapted to be operated for rendering either one of said receipt and journal paper feeding and printing mechanisms to be inoperative and a switch connecting said one of said receipt and journal paper feeding and printing mechanisms to said control circuit, said switch being operatively coupled with said mechanical switching means so as to be opened when said switching means is operated to render said one of said receipt and journal paper feeding and printing mechanisms to be inoperative.

With the printer of the present invention constructed as described above, all the above described disadvantages of the prior art printer can be avoided positively without causing any false functions, while the manipulation of the cash register is made simple and the design of the register is made simple and the manufacturing cost can be saved.

DETAILED DESCRIPTION OF THE PREFERRED EMBODIMENT

Figure 1:
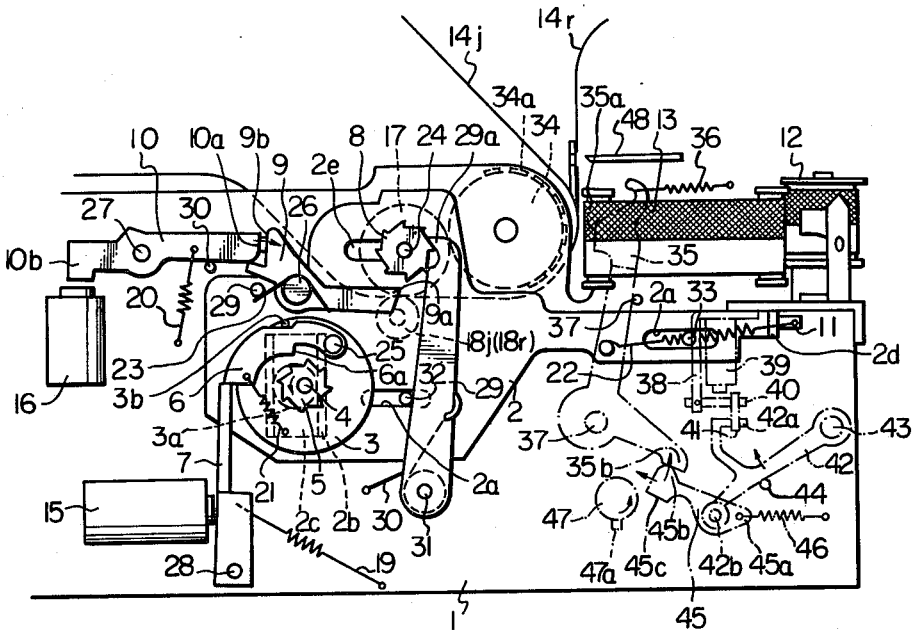
FIG. 1 is a schematic side view showing a printer adapted to incorporate the present invention.

The printer adapted to incorporate the present invention shown in FIG. 1 comprises a pair of side plate one of which is designated in FIG. 1 by the reference numeral 1. A slide plate 2 is slidably mounted on the side plate 1 and guided for the horizontal reciprocating movement by elongated holes 2*a*, 2*a* formed therein and each slidably engaging with pins 32, 33 secured to the side plate 1.

The slide plate 2 is formed with a pair of vertical parallel bent lugs 2*b*, 2*b* forming therebetween an opening 2*c* adjacent to the left side end in the figure and a bent lug 2*d* at the right side end. A driving shaft 4 adapted to be continuously rotated in the counterclockwise direction during the operation of the printer is supported by the side plates 1 and loosely passes through the opening 2*c* of the slide plate 2. The shaft 4 has a ratchet wheel 5 secured at the end thereof as shown and the shaft 4 rotatably mounts thereon a clutch disc 3 adjacent to the ratchet wheel 5.

The disc 3 is integrally formed therewith an eccentric cam 3*a* on the side of the disc 3 opposite to the side adjacent to the ratchet wheel 3 and the cam 3*a* is slidably and rotatably engaged with the pair of bent lugs 2*b* of the slide plate 2 so that the slide plate 2 is moved reciprocally once from the left as shown toward the right and is moved back toward the left each time the disc 3 is rotated by one revolution.

As described later, the slide plate 2 is adapted to be moved reciprocally once per one printing operation of the printer.

Figure 2:
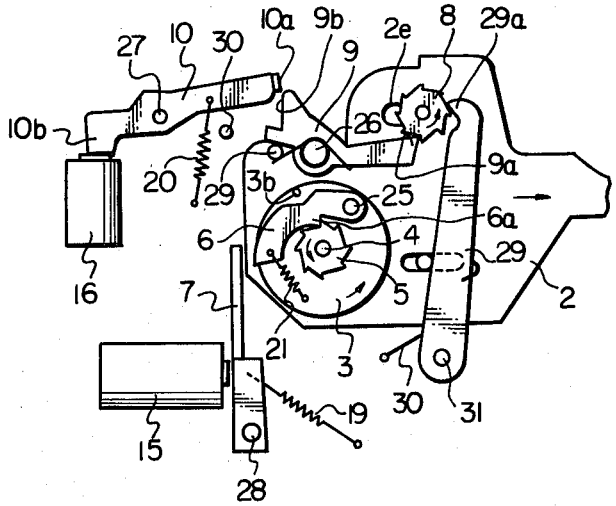
FIG. 2 is a fragmentary side view showing a portion of the printer of FIG. 1 in another mode of operation.

In order to rotate the clutch disc 3 by one revolution for effecting one reciprocal movement of the slide 2 for each printing operation, a swingable clutch lever 6 is swingably mounted on the clutch disc by a pin 25 secured to the disc 3, and the lever 6 is formed with a ratchet claw 6*a* releasably engageable with the ratchet wheel 5 and is urged in the counterclockwise direction by a spring 21 having one end secured to the lever 6 and the other end secured to the disc 3 as shown, but the ratchet claw 6*a* of the lever 6 is normally held apart from the ratchet wheel 5 as shown by a swingable magneticaly actuatable trigger lever 7 swingably supported on the side plate 1 by a shaft 28 secured thereto and urged in the clockwise direction by a spring 19 having one end secured to the lever 7 and the other end secured to the side plate 1 so that the free upper end of the lever 7 is adapted to slidably engage with the outer periphery of the clutch disc 3 and abuts against the free end of the clutch lever 6 projecting beyond the outer periphery of the disc 3 so as to urge the lever 6 against the action of the spring 21 to arrest the lever 6 in abutting relationship against a stopper pin 3*b* secured to the disc 3 thereby maintaining the clutch disc 3 in the position shown in FIG. 1. An electromagnet 15 is arranged on the side plate 1 so as to cooperate with the trigger lever 7 so that, when the electromagnet 15 is energized for a short time period, the trigger lever 7 is attracted by the magnet 15 and is swung in the counterclockwise direction against the action of the spring 19 so that the clutch lever 6 is released from the trigger lever 7 as shown in FIG. 2 thereby permitting the clutch lever 6 to be swung inwardly of the disc 3 by the action of the spring 21 so as to engage the ratchet claw 6*a* with the rotating ratchet wheel 5 of the driving shaft 4 for rotating the clutch disc 3 in the counterclockwise direction together with the driving shaft 4. After one revolution of the disc 3, the free end of the clutch lever 6 which is held projected beyond the outer periphery of the clutch disc 3 during the rotation of the disc 3 is arrested by the free end of the trigger lever 7 which has been swung in the clockwise direction by the action of the spring 19 to slidably contact with the outer periphery of the disc 3 because of the deenergization of the electromagmagnet 15 having been effected shortly after the energization thereof, thereby arresting the clutch disc 3 in the position as shown in FIG. 1 after one complete revolution thereof.

An ink ribbon feeding lever 11 coupled with ink ribbon reels 12 in the well known manner abuts against the bent lug 2*d* of the slide lever 2 and resiliently urged thereagainst by a spring 22 having one end secured to the ink ribbon feeding lever 11 and the other end secured to the slide lever 2 by a pin, so that the ink ribbon 13 stretched between the ink ribbon reels 12 for the printing operation is fed by a predetermined amount each time the slide lever 2 is moved reciprocally by the revolution of the clutch disc 3.

The printer shown is adapted to be incoporated in an electronic cash register and a receipt paper feeding and printing mechanism and a journal paper feeding and printing mechanism are provided in juxtaposed relationship to each other for simultaneously effecting the same printing operation on the receipt paper 14*r* and the journal paper 14*j* fed from supply rolls thereof (not shown). The receipt paper feeding and printing mechanism and the journal paper feeding and printing mechanism are substantially similar in construction except that the journal paper 14*j* after having been printed by the journal paper feeding and printing mechanism is wound on a reel (not shown) for the record of the printing while the receipt paper 14*r* after having been printed by the receipt paper feeding and printing mechanism is severed by a cutter 48 schematically shown in FIG. 1 to form receipts to be delivered to customers and the receipt paper feeding and printing mechanism is additionally provided with a mechanism of the present invention for optionally rendering the same to be inoperable to be described later.

Therefore, the portions of only the receipt paper feeding and printing mechanism common to the journal paper feeding and printing mechanism will first be described in connection with FIG. 1.

The receipt paper feeding and printing mechanism shown in FIG. 1 comprises a printing drum 34 rotatably supported by the side plates 1 and rotated during the printing operation and bearing on the outer peripheral surface a plurality of rows each including a predetermined number of printing characters 34*a* at a predetermined pitch along the peripheral direction thereof and a receipt paper feeding roller 17 such as a rubber roller secured to a paper feeding shaft 24 rotatably supported by the side plates 1 and passes loosely through an elongated hole 2*e* of the slide plate 2 for allowing the reciprocal movement thereof. As shown a ratchet wheel 8 is secured to the shaft 24 at one end thereof. A pressing roller 18*r* is arranged in compressive contact with the feeding roller 17 so that the receipt paper 14*r* fed from the supply roll thereof and sandwiched between the rollers 17, 18*r* is fed by a predetermined amount for the successive printing operation when the feeding roller 17 is driven in the counterclockwise direction by an angle as determined by the pitch of the ratchet wheel 8 as described later.

In order to rotate the ratchet wheel 8 by a pitch of the ratchet teeth thereof for feeding the receipt paper 14*r*, a ratchet lever 9 is swingably supported at its intermediate portion on the slide lever 2 by a shaft 26 secured thereto. The lever 9 is urged in the counterclockwise direction by a spring 23 wound around the shaft 26 and having one end engaged with the lever 9 and the other end arrested by a pin 29 secured to the slide lever 2 so that the ratchet claw 9*a* at one end of the lever 9 is urged to engage with the ratchet wheel 8, but the claw 9*a* is held apart from the ratchet wheel 8 against the action of the spring 23 by the engagement of the opposite end 9*b* of the lever 9 with one end 10*a* of an actuating lever 10 swingably supported on the side plate 1 by a shaft 27 and urged in the clockwise direction by a spring 20 having one end secured to the lever 10 and the other end secured to the side plate 1, a stopper pin 30 serving to limit the clockwise movement of the lever 10. The magnetically actuatable other end 10*b* of the actuating lever 10 cooperates with an electromagnet 16 mounted on the side plate 1, so that, when the magnet 16 is energized, the lever 10 is attracted thereby so as to be swung in the counterclockwise direction to release the end 9*b* of the ratchet lever 9 from the end 10*a* of the lever 10, thus permitting the ratchet lever 9 to swing in the counterclockwise direction by the action of the spring 23 so as to engage the ratchet claw 9*a* with the ratchet wheel 8 as shown in FIG. 2.

Under such a condition, when the electromagnet 15 is energized for a short time period to effect a reciprocal movement of the slide plate 2 as described previously, the ratchet wheel 8 is rotated in the counterclockwise direction by the ratchet lever 9 by a pitch of the ratchet wheel 8 as shown in FIG. 2 so that the receipt paper 14*r* is fed the predetermined amount for the next printing operation by the counterclockwise rotation of the feeding roller 17 in cooperation with the pressing roller 18*r*. A stopper lever 29 pivoted on the side plate 1 by a shaft 31 and urged in the counterclockwise direction by a spring 30 as shown is provided in order to prevent the clockwise rotation of the feeding roller 17 by virtue of the releasable engagement of the stopper claw 29*a* of the lever 29 with the ratchet tooth of the ratchet wheel 8.

For effecting the printing operation on the receipt paper 14*r*, a plurality of printing hammers 35 corresponding in number and location to the respective printing characters 34*a* in each row provided on the periphery of the printing drum 34 are swingably supported by a shaft 37 secured to the side plates 1. The striking portion 35*a* of each hammer 35 is located in facing relationship to the respective printing character 34*a* on periphery of the printing drum 34 and the receipt paper 14*r* and the ink ribbon 13 are interposed between the drum 34 and each striking portion 35*a* of the hammer 35. The respective printing hammer 35 is urged in the clockwise direction by a spring 36 and held in position by a stopper 37 so as to maintain the striking portion 35*a* apart from the periphery of the drum 34. The respective hammer 35 is formed with an arm 35*b*, so that, when the arm 35*b* is striken in the counterclockwise direction, the hammer 35 is swung in the counterclockwise direction against the action of the spring 36 so that the striking portion 35*a* strikes the character 34*a* with the paper 14*r* and the ribbon 13 sandwiched therebetween thereby effecting the printing on the receipt paper 14*r* in the manner well known.

In order to effect the acutation of each printing hammer 35, a select lever 42 is provided corresponding to the respective hammer 35. Each select lever 42 is swingably supported by a shaft 43 secured to the side plates 1 and a hammer control lever 45 is swingably mounted at its intermediate portion by a pin 42*b* on the free end of the respective select lever 42. A spring 46 is secured at its one end to one end 45*a* of each hammer control lever 45 while the other end is secured to the stationary point in the printer so that the select lever 42 is urged in the counterclockwise direction but is held by a stopper pin 44. The other end of the respective hammer control lever 45 is formed with a striking head 45*b* abutting against the arm 35*b* of each printing hammer 35 and a driven portion 45*c* adapted to be selectively striken by a projection 47*a* of a driving shaft 47 which is rotated during the printing operation at a speed at which it is rotated by one revolution each time the printing drum 34 is rotated by an angle corresponding to a pitch between adjacent two rows of the printing characters 34*a*.

In the positions shown in FIG. 1, the driven portion 45*c* of each hammer control lever 45 is out of the path of movement of the projection 47*a* of the driving shaft 47 by virtue of the action of the spring 46 so that the hammer control lever 45 is held inoperative by the rotation of the driving shaft 47. In order to selectively actuate the respective hammer control lever 45 by the driving shaft 47, each select lever 42 is formed with an L-shaped arm having a hook portion 42*a* at its free end and the hook portion 42*a* is operatively connected through a connecting lever 41 to a magnetically actuatable actuator lever 40 swingably supported by an L-shaped plate 38 secured to the printer and mounting thereon an electromagnet 39 adapted to attract the actuator lever 40 when energized. Thus, when the selected electromagnet 39 is energized to attract the actuator lever 40, the select lever 42 is swung in the clockwise direction to move the hammer control lever 45 toward the left against the action of the spring 46 so that the driven portion 45*c* of the lever 45 is moved into the path of movement of the projection 47*a* of the driving shaft 47 thereby permitting the projection 47*a* to strike the lever 45 so as to move the printing hammer 35 in the counterclockwise direction for effecting the printing onto the receipt paper 14*r*.

The energization of the selected electromagnet 39 is controlled by the printing signal given by a control circuit of the printer so that the selected hammer 35 is actuated when the desired character 34*a* on the drum 34 is brought to the position at which the hammer 35 strikes the drum 34 as it is rotating during the operation of the printer.

In like manner, the energization of the electromagnet 15 is effected after the completion of the printing operation by the signal given from the control circuit in timed relationship to the completion of one cycle of the printing operation so as to feed the ink ribbon 13. The electromagnet 16 is also energized by the control circuit when it is desired to feed the paper in synchronism with the energization of the electromagnet 15.

Figure 3:
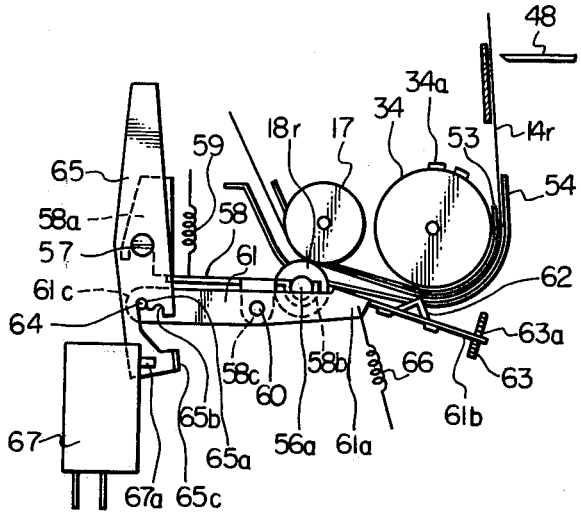
FIG. 3 is a schematic side view showing an embodiment of the present invention.
Figure 4:
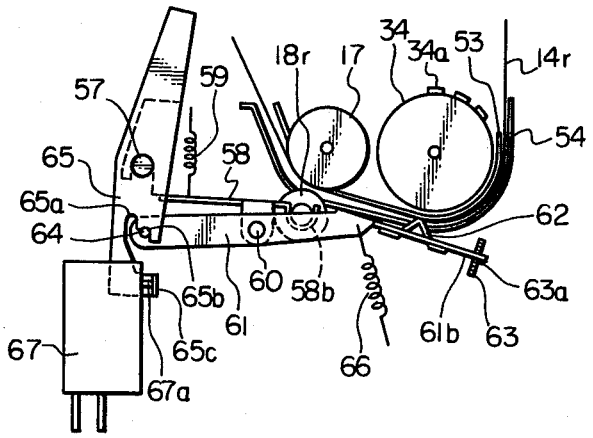
FIG. 4 is a schematic side view similar to FIG. 3 but showing another mode of operation.

In accordance with the present invention, a mechanical switching means is provided for optionally rendering the receipt paper feeding and printing mechanism to be inoperative as shown in FIGS. 3 and 4.

The switching means comprises a manually operable swingable switching lever 65 pivotally supported at its intermediate portion by a shaft 57 secured to the side plate not shown in FIG. 3, a pressing roller supporting lever 58 rotatably supporting the pressing roller 18*r* at its one end and swingably supported at its other end by the shaft 57 and urged in the counterclockwise direction by a spring 59 having one end secured to the lever 58 and the other end secured to a stationary point in the printer so as to urge the pressing roller 18*r* against the feeding roller 17 with the receipt paper 14*r* sandwiched therebetween, and a paper arresting lever 61 swingably supported at its intermediate portion by a shaft 60 to a lug 58*c* formed on the lever 58 adjacent to the pressing roller 18*r*.

The receipt paper sandwiched between the pressing roller 18*r* and the feeding roller 17 is lead along between paper guides 53 and 54 around the printing drum 34 as shown in FIG. 3, openings being formed in both the paper guides 53, 54 for allowing the printing hammers (not shown in FIG. 3) to strike the drum 34 for the printing operation.

The paper arresting lever 61 is provided at its one end 61*a* with a resilient plate 61*b* mounting thereon a paper arresting ridge 62 adapted to pass through an opening formed in the paper guide 54 and urge the receipt paper 14*r* against the paper guide 53 so as to arrest the movement of the receipt paper 14*r* when the paper arresting lever 61 is swung in the counterclockwise direction, but the lever 61 is urged in the clockwise direction by a spring 66 having one end secured to the end 61*a* of the lever 61 and the other end secured to a stationary point in the printer, the range of movement of the lever 61 being limited by an opening 63*a* of a stopper plate 63 secured to the printer through which the free end of the resilient plate 61*b* passes as shown.

The switching lever 65 has a bent lug 65*c* at its lower end which cooperates with an actuator 67*a* of a normally closed switch 67 connected in the control circuit for the electromagnets 39 of the receipt paper printing mechanism to be described later with reference to FIG. 5, so that, when the switching lever 65 is selectively switched to the position shown in FIG. 3 in which the bent lug 65*c* is held apart from the actuator 67*a* of the switch 67, the control circuit for the receipt paper 14*r* is held operable, while, when the switching lever 65 is swung in the clockwise direction to push the actuator 67*a* of the switch 67 by the bent lug 65*c* of the lever 65 as shown in FIG. 4, the switch 67 is opened so that the control circuit of the electromagnets 39 for the receipt paper printing mechanism is rendered to be inoperable.

A pin 64 is secured to the other end 61*c* of the paper arresting lever 61 which cooperates selectively with a first cam 65*a* and a second cam 65*b* formed in the switching lever 65 as shown in FIG. 3 by virtue of the provision of the spring 66. The second cam 65*b* is contiguous to the first cam 65*a* and the first cam 65*a* is configured to be higher or deeper than the second cam 65*b* as shown so that the position of the paper arresting lever 61 and, hence, the position of the pressing roller supporting lever 58 are varied to allow the feeding of the receipt paper 14*r* or arrest the same depending upon which of the cams 65*a* or 65*b* engages with the pin 64 by the selected position of the lever 65 which also determines the closure or opening of the switch 67.

In operation, when the switching lever 65 is held in the position shown in FIG. 3 for maintaining the switch 67 in closed state for activating the control circuit of the electromagnets 39 for the receipt paper printing mechanism, the pin 64 of the paper arresting lever 61 engages with the first cam 65*a* so that the end 61*c* of the lever 61 is allowed to be raised relative to the end of the resilient plate 61*b* which is arrested by the lower edge of the opening 63*a* of the stopper plate 63 by virtue of the action of the spring 66. In this position of the resilient plate 61*b*, the paper arresting ridge 62 is held apart from the receipt paper 14*r* so that the paper 14*r* is free to be fed, while the pressing roller supporting lever 58 is allowed to be swung in the counterclockwise direction by the action of the spring 59 to urge the pressing roller 18*r* against the feeding roller 17 with the receipt paper 14*r* sandwiched therebetween for permitting the receipt paper 14*r* to be fed by the rotation of the feeding roller 17 as described previously by virtue of the fact that the shaft 60 secured to the lever 61 and swingably supporting the lever 58 can be relatively raised together with the pin 64 at the end 61*c* of the lever 61 engaging with the first cam 65*a* of the switching lever 65. Thus, the receipt paper 14*r* can be printed and fed in synchronism with the journal paper 14*j*.

In order to render the receipt paper feeding and printing mechansim to be inoperative while the journal paper feeding and printing mechanism is held operative, the switching lever 65 is switched in the clockwise direction toward the position shown in FIG. 4, then the pin 64 of the lever 61 is disengaged from the first cam 65*a* and lowered during the sliding movement thereof toward the second cam 65*b* so that the paper arresting lever 61 is first swung in the counterclockwise direction about the shaft 60 against the action of the spring 66 thereby urging the paper arresting ridge 62 against the paper guide 53 with the receipt paper 14*r* sandwiched therebetween so as to arrest the same wherein the end of the resilient plate 61*b* is resiliently arrested by the upper edge of the opening 63*a* of the stopper plate 63. When the pin 64 is engaged in the second cam 65*b* at the final stage of the clockwise swinging movement of the switching lever 65, the pin 64 is further lowered so that the lever 61 is then swung in the counterclockwise direction around the free end of the resilient plate 61*b* arrested by the upper edge of the opening 63*a* of the stopper plate 63 thereby lowering the shaft 60. Thus, the pressing roller supporting lever 58 pivotally connected to the shaft 60 is swung in the clockwise direction against the action of the spring 59 by virtue of the downward movement of the shaft 60 thereby moving the pressing roller 18*r* apart from the feeding roller 17 so as to render the feeding of the receipt paper 14*r* by the feeding roller 17 to be inoperable and, at the same time, the switch 67 is opened to render the control circuit of the electromagnets 39 for the receipt paper printing mechanism to be inoperative by the clockwise swinging movement of the switching lever 65.

The resilient plate 61*b* serves to render the switching operation as described above to be smooth and accurate.

Figure 5:
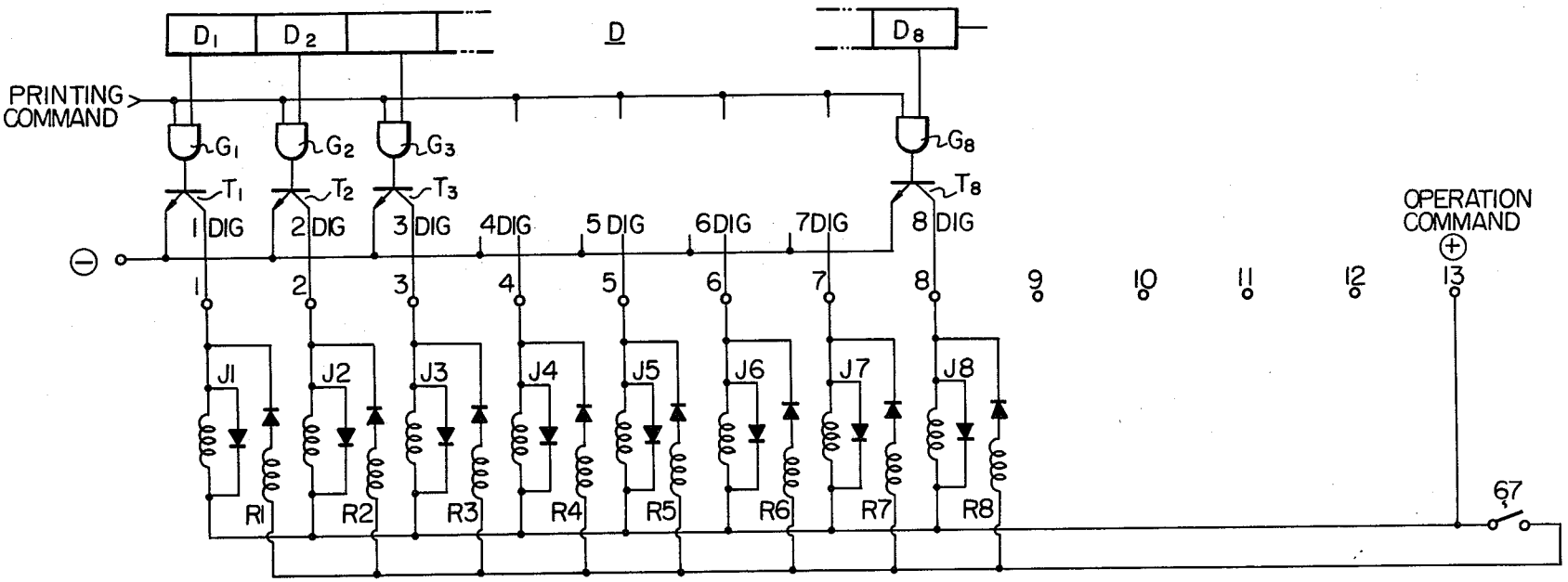
FIG. 5 is a wiring diagram showing the electric circuit for selectively inactivating the receipt paper feeding and printing mechanism of the present invention.

FIG. 5 shows an example of the control circuit of the electromagnets 39 for the receipt and journal paper printing mechanisms.

In FIG. 5, $J_1$, $J_2$ - designate the solenoid coils fo the electromagnets 39 for the journal paper printing mechanism each corresponding to the respective printing characters 34*a* in each row while $R_1$, $R_2$ - designate similarly the solenoid coils of the electromagnets 39 for the receipt paper printing mechanism. The figure signal generating circuit D includes stages $D_1$, $D_2$ - which selectively issue signals for energizing selected printing characters 34*a* in each row. The output each of the stages $D_1$, $D_2$- is connected to one input of AND gate $G_1$, $G_2$ -, the other input of which is connected commonly to the printing command signal terminal of the control circuit of the printer for issuing printing signal in timed relationship to the rotation of the printing drum 34 so as to bring the respective row of the printing characters 34*a* to the position at which it is striken by the selected printing hammers 35.

The output each of AND gates $G_1$, $G_2$, - is connected to the base of the respective transistor $T_1$, $T_2$, -, while the collector of which is connected to the common terminal of the parallelly connected solenoid coils $J_1$, $R_1$; $J_2$, $R_2$;, $J_3$, $R_3$ -.

The other terminal of each of the solenoid coils $J_1$, $J_2$,-is commonly connected to the plus operation command terminal of the control circuit of the printer adapted to apply a predetermined plus voltage to the respective solenoid coils $J_1$m $J_2$, - during the printing operation.

The emitter each of the transistors $T_1$, $T_2$, - is commonly connected to a minus operation command terminal of the control circuit.

The other terminal each of the solenoid coils $R_1$, $R_2$, - is commonly connected to the plus operation command terminal through the above described switch 67 as shown.

In operation, when the switching lever 65 is in the position shown in FIG. 3 in which the switch 67 is held closed while the pressing roller 18*r* is in pressing contact with the feeding roller 17 and the paper arresting ridge 62 is held apart from the paper guide 53 freeing the receipt paper 14*r*, both the journal and receipt paper printing mechanisms are operative and the selected figures of each row of the printing characters 34*a* are printed onto both the journal and receipt papers 14*j*, 14*r* when the selected stages $D_1$, $D_2$ - issue the outputs applied to the AND gates $G_1$, $G_2$, - and the printing command signal is issued from the control circuit so as to open the selected AND gates $G_1$, $G_2$, - rendering corresponding transistors $T_1$, $T_2$, - to be conductive thereby energizing the sets of solenoid coils $J_1$, $R_1$; $J_2$, $R_2$; -.

When the switching lever 65 is switched to the position shown in FIG. 4 in which the switch 67 is opened while the paper arresting ridge 62 is first brought to the position arresting the receipt paper 14*r* and then the pressing roller 18*r* is moved apart from the feeding roller 17, then the solenoid coils $J_1$, $J_2$, - are disconnected from the plus operation command terminal so that the feeding and printing of the receipt paper 14*r* are rendered to be inoperative even though the journal paper 14*j* is printed and fed by the actuation of the respective stages $D_1$, $D_2$ - and the application of the printing command signal to the AND gates $G_1$, $G_2$, -.

I claim:

1. Printer having at least a receipt paper feeding and printing mechanism and a journal paper feeding and printing mechanism each adapted to be operated in synchronism by a control circuit, wherein the improvement comprises mechanical switching means adapted to be operated for rendering either one of said receipt and journal paper feeding and printing mechanisms to be inoperative and a switch connecting said one of said receipt and journal paper feeding and printing mechanisms to said control circuit, said switch being operatively coupled with said mechanical switching means so as to be opened when said switching means is operated to render said one of said receipt and journal paper feeding and printing mechanisms to be inoperative.

2. Printer according to claim 1, wherein said switching means comprises a switching lever cooperating with said switch and movable between a first positon in which it maintains said switch in closed position and a second position in which it opens said switch, said switching lever being formed with cam means including a first cam portion and a second cam portion contiguous thereto, a pressing roller supporting lever rotatably supporting at its one end a pressing roller cooperating with a paper feeding roller of said one of said receipt or journal paper feeding and printing mechanisms and urged by a first spring so as to resiliently pressing said pressing roller to said paper feeding roller, and a paper arresting lever pivotally supported at its intermediate portion to said pressure roller supporting lever adjacent to said pressing roller, said paper arresting lever having at its one end a paper arresting ridge adapted to arrest the paper to be fed by said paper feeding roller when said paper arresting lever is swung in one direction while said paper arresting lever is urged by a second spring in the opposite direction to release the paper, said paper arresting lever having at its other end pin means cooperating with said cam means of said switching lever so that, when said switching lever is in said first position so as to close said switch, said pin means engages with said first cam portion so as to allow said paper arresting lever to be swung in said opposite direction by said second spring thereby maintaining said pressing roller in pressing contact with said paper feeding roller by said first spring while, when said switching lever is in said second position so as to open said switch, said pin means engages with said second cam portion so that said paper arresting lever is swung in said one direction to arrest the paper and said pressing roller is moved apart from said paper feeding roller.

3. Printer according to claim 2, wherein restricting means is provided to limit the swinging movement of said paper arresting lever.

* * * * *

UNITED STATES PATENT AND TRADEMARK OFFICE

CERTIFICATE OF CORRECTION

PATENT NO. : 4,188,138

DATED : February 12, 1980

INVENTOR(S) : Masao Yamazaki

It is certified that error appears in the above-identified patent and that said Letters Patent are hereby corrected as shown below:

Column 7, Line 6 insert --pin-- between "which" and "cooperates"

Column 8, Line 13 change "fo" to --of--

Signed and Sealed this

*Twenty-third* Day of *September 1980*

[SEAL]

*Attest:*

SIDNEY A. DIAMOND

*Attesting Officer*

*Commissioner of Patents and Trademarks*